US010992045B2

(12) United States Patent
Patton et al.

(10) Patent No.: US 10,992,045 B2
(45) Date of Patent: Apr. 27, 2021

(54) MULTI-BAND PLANAR ANTENNA

(71) Applicant: Neptune Technology Group Inc., Tallassee, AL (US)

(72) Inventors: Damon Lloyd Patton, Wetumpka, AL (US); Richard Brown DeWitt, Auburn, AL (US)

(73) Assignee: Neptune Technology Group Inc., Tallassee, AL (US)

( * ) Notice: Subject to any disclaimer, the term of this patent is extended or adjusted under 35 U.S.C. 154(b) by 0 days.

(21) Appl. No.: 16/732,457

(22) Filed: Jan. 2, 2020

(65) Prior Publication Data

US 2020/0136258 A1 Apr. 30, 2020

Related U.S. Application Data

(63) Continuation-in-part of application No. 16/593,367, filed on Oct. 4, 2019.

(60) Provisional application No. 62/749,330, filed on Oct. 23, 2018.

(51) Int. Cl.

| | |
|---|---|
| ***H01Q 9/26*** | (2006.01) |
| ***H01Q 9/28*** | (2006.01) |
| ***H01Q 5/10*** | (2015.01) |
| ***H01Q 5/335*** | (2015.01) |

(52) U.S. Cl.

CPC ..... *H01Q 9/26* (2013.01); *H01Q 5/10* (2015.01); *H01Q 5/335* (2015.01); *H01Q 9/285* (2013.01)

(58) Field of Classification Search

CPC .. H01Q 5/15; H01Q 9/26; H01Q 5/10; H01Q 5/335; H01Q 9/285

See application file for complete search history.

(56) References Cited

U.S. PATENT DOCUMENTS

| | | | | | |
|---|---|---|---|---|---|
| 2,640,933 | A * | 6/1953 | Spindler | H01Q 5/49 | 343/794 |
| 2,888,678 | A * | 5/1959 | Weiss | H01Q 5/49 | 343/814 |
| 2,980,912 | A * | 4/1961 | Anderson | H01Q 5/49 | 343/802 |
| 4,528,568 | A * | 7/1985 | Woloszczuk | H01Q 9/26 | 343/770 |
| 4,853,705 | A * | 8/1989 | Landt | H01Q 1/247 | 343/803 |
| 5,068,672 | A * | 11/1991 | Onnigian | H01P 5/10 | 343/859 |

(Continued)

OTHER PUBLICATIONS

Zedong Wang et al. "A Broadband Dual-Element Folded Dipole Antenna With a Reflector." 750 IEEE Antennas and Wireless Propagation Letters, vol. 13, 2014, 4 pages.

(Continued)

*Primary Examiner* — Graham P Smith

*Assistant Examiner* — Jae K Kim

(74) *Attorney, Agent, or Firm* — Snyder, Clark, Lesch & Chung, LLP

(57) ABSTRACT

An antenna includes a first folded dipole having a first central region, and a second folded dipole having a second central region and connected in parallel to the first folded dipole. The antenna further includes a first pair of tuning stubs extending into the first central region of the first folded dipole, and a second pair of tuning stubs extending into the second central region of the second folded dipole.

20 Claims, 11 Drawing Sheets

(56) References Cited

U.S. PATENT DOCUMENTS 5,322,984 A * 6/1994 Habeger, Jr. ..... B65D 81/3446 219/728
5,592,185 A * 1/1997 Itabashi ..... H01Q 3/2682 343/767
5,821,902 A 10/1998 Keen
5,917,450 A 6/1999 Tsunekawa et al.
6,317,099 B1 * 11/2001 Zimmerman ..... H01Q 1/246 343/747
6,650,301 B1 * 11/2003 Zimmerman ..... H01Q 1/246 343/803
6,822,618 B2 11/2004 Bisiules et al.
6,956,472 B1 * 10/2005 Walcott, Jr. ..... G06K 19/07749 340/10.1
7,292,200 B2 * 11/2007 Posluszny ..... H01Q 1/243 343/700 MS
8,446,331 B2 5/2013 Johnson
8,686,912 B2 4/2014 Bin Jamlus et al.
8,860,617 B1 * 10/2014 Fenick ..... H01Q 9/285 343/730
8,952,858 B2 2/2015 de Rochemont
2004/0080464 A1 * 4/2004 Suganthan ..... H01Q 5/371 343/795
2004/0222936 A1 * 11/2004 Hung ..... H01Q 5/371 343/795
2005/0073465 A1 * 4/2005 Olson ..... H01Q 5/42 343/795
2006/0071864 A1 * 4/2006 Richard ..... H01Q 1/362 343/702
2010/0097285 A1 * 4/2010 Hayashi ..... H01Q 9/28 343/803
2010/0238087 A1 * 9/2010 Jung ..... H01Q 9/26 343/810
2010/0283688 A1 * 11/2010 Kinezos ..... H01Q 9/0421 343/702
2010/0302117 A1 12/2010 Johnson
2011/0063181 A1 * 3/2011 Walker ..... H01Q 25/005 343/803
2011/0248900 A1 * 10/2011 de Rochemont ..... H01Q 5/15 343/803
2011/0291836 A1 * 12/2011 Deavours ..... G06K 19/07775 340/572.7
2014/0218258 A1 * 8/2014 Walker ..... H01Q 1/007 343/848
2015/0070228 A1 * 3/2015 Gu ..... H01Q 1/2283 343/727
2016/0043473 A1 * 2/2016 Walker ..... H01Q 1/38 343/835
2016/0149293 A1 * 5/2016 Walker ..... H01Q 9/16 343/718
2018/0069291 A1 * 3/2018 Davis ..... H01Q 1/2225
2019/0393729 A1 * 12/2019 Contopanagos ..... H01Q 21/24
2020/0106184 A1 * 4/2020 Fabrega Sanchez .... H01Q 1/38

OTHER PUBLICATIONS

E. S. Pires et al. "Metamaterial-Inspired Wire Antennas." IEEE Transactions on Magnetics, vol. 49, No. 5, May 2013, 1893, 4 pages.

B. H. Ahmad et al. "Dual band printed folded dipole antenna for wireless communication at 24 GHz and 35 GHz applications." 2015 Asia-Pacific Microwave Conference (APMC), Dec. 6-9, 2015, 3 pages.

Hubregt J. Visser "Printed folded dipole antenna design for rectenna and RFID applications." 7th European Conference on Anntennas and Propagation (EUCAP 2013)—Convened Sessions, 4 pages.

Makoto Sumi "Broadband folded offset fed printed dipole antenna for GSMNV-CDMA/LTE/WiFi/Bluetooth M2M applications." 2015 IEEE 4th Asia-Pacific Conference on Antennas and Propagation (APCAP), Jun. 30-Jul. 2015, 2 pages.

* cited by examiner

| | Band Designation | Freq. |
|---|---|---|
| 1 | LTE Band 13 (downlink) | 746-756 MHz |
| 2 | LTE Band 13 (uplink) | 777-787 MHz |
| 3 | 900 MHz ISM | 902-928 MHz |
| 4 | LTE Band 4 (uplink) | 1710-1755 MHz |
| 5 | LTE Band 4 (downlink) | 2110-2155 MHz |
| 6 | 2.4 GHz ISM (Bluetooth) | 2400-2483.5 MHz |

750 MHz Radiation Pattern

1800 MHz Radiation Pattern

2150 MHz Radiation Pattern

MULTI-BAND PLANAR ANTENNA

CROSS-REFERENCE TO RELATED APPLICATION

The present application is a continuation-in-part (CIP) of U.S. application Ser. No. 16/593,367, entitled "Compact Folded Dipole Antenna With Multiple Frequency Bands" and filed Oct. 4, 2019, which claims priority under 35 U.S.C. § 119 based on U.S. Provisional Application No. 62/749,330, filed Oct. 23, 2018, the disclosures of which are both hereby incorporated by reference herein in their entirety.

BACKGROUND

Dipole antennas are commonly used for wireless communications. A dipole antenna typically includes two identical conductive elements to which a driving current from a transmitter is applied, or from which a received wireless signal is applied to a receiver. A dipole antenna most commonly includes two conductors of equal length oriented end-to-end with a feedline connected between them. A half-wave dipole includes two quarter-wavelength conductors placed end to end for a total length (L) of approximately $L=\lambda/2$, where $\lambda$ is the wavelength corresponding to the intended frequency (f) of operation. A folded dipole antenna consists of a half-wave dipole with an additional wire connecting its two ends. The far-field emission pattern of the folded dipole antenna is nearly identical to the half-wavelength dipole, but typically has an increased impedance and a wider bandwidth. Half-wavelength folded dipoles are used for various applications including, for example, for Frequency Modulated (FM) radio antennas.

DETAILED DESCRIPTION OF THE PREFERRED EMBODIMENTS

Figure 1:
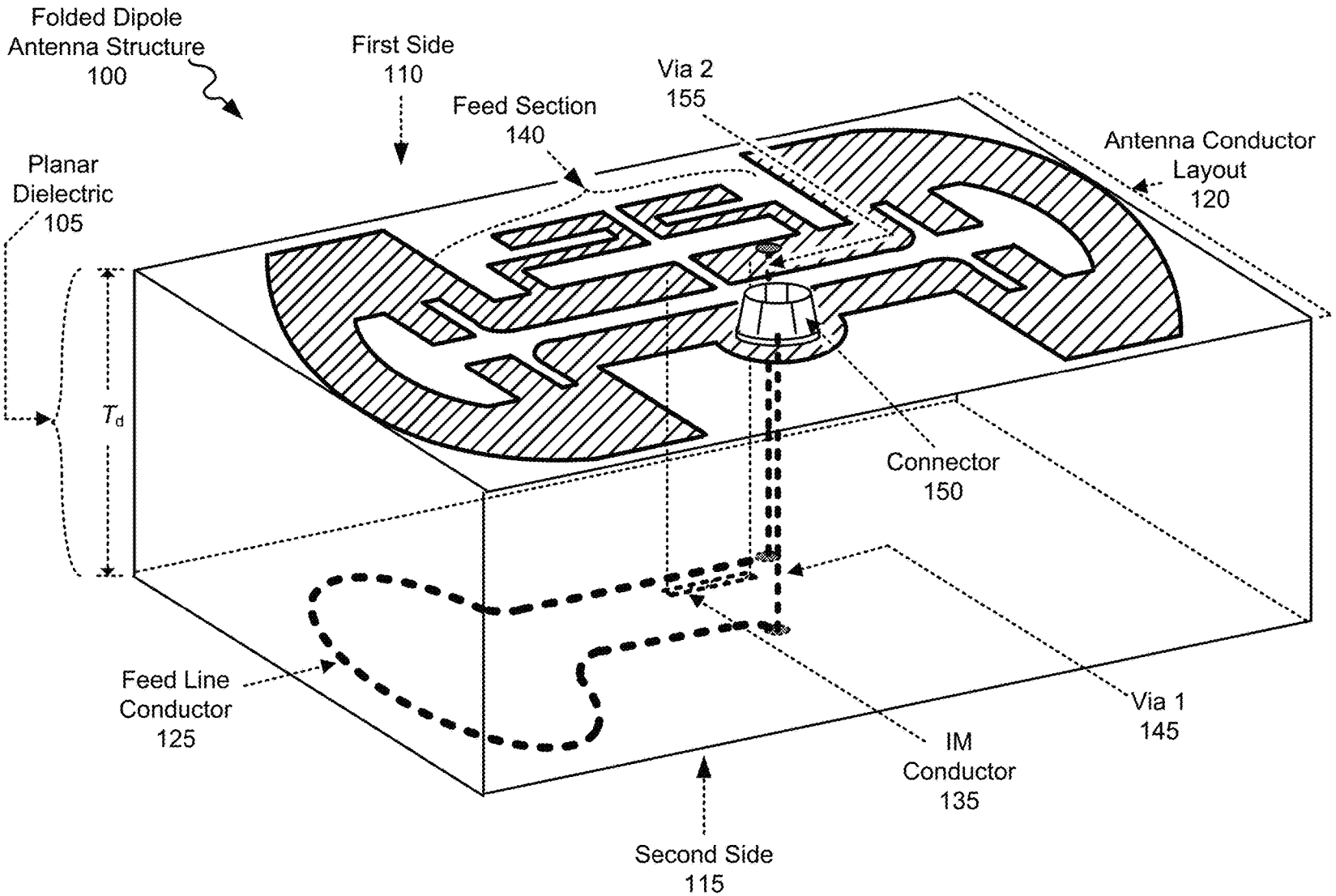
FIG. 1 depicts a three-dimensional view of a folded dipole antenna structure according to an exemplary implementation.

The following detailed description refers to the accompanying drawings. The same reference numbers in different drawings may identify the same or similar elements. The following detailed description does not limit the invention.

A compact folded dipole antenna structure, as described herein, includes two parallel connected, folded dipoles that may be formed on a first side of a planar dielectric, such as a printed circuit board (PCB), and a feed line and a tunable impedance matching element that may be formed on a second, opposite side of the planar dielectric. The resulting antenna structure is compact and self-resonant such that the antenna structure does not need to be attached to another structure to resonate. Each of the folded dipoles of the antenna structure includes, within a non-conductive central region of each folded dipole, a pair of tuning stubs that control higher resonant frequencies of the antenna structure. Various dimensions associated with the pair of tuning stubs may be tuned to adjust the higher resonant frequencies of the antenna structure.

The antenna structure of the compact folded dipole antenna further includes a first tuning element and a second tuning element connected to an antenna feed section associated with the first folded dipole and the second folded dipole. The first and second tuning elements may be formed on the first side of the planar dielectric and control lower resonant frequencies of the antenna structure. Various dimensions associated with the first and second tuning elements may be tuned to adjust the lower resonant frequencies of the antenna structure.

The tunable impedance matching element that may be formed on the second side of the planar dielectric and extend across a gap between respective portions of the antenna feed section associated with the two folded dipoles. Since current is balanced in the layout of the antenna structure, no external balun needs to be used with the antenna structure. The feed line that may be formed on the second side of the planar dielectric may also include a microstrip feed line that may be formed integrally with the antenna conductor layout, eliminating a need for an external coaxial structure.

The compact folded dipole antenna structure described herein may resonate at multiple different frequencies spanning a range from approximately 675 Megahertz (MHz) to approximately 2500 MHz. The pairs of tuning stubs of the two parallel-connected folded dipoles, and the tuning elements connected to the respective antenna feed sections of the two folded dipoles, may be tuned to adjust both the lower and higher resonant frequencies of the antenna structure.

The antenna structure described herein may be used in, for example, a meter such as a utility meter (e.g., a water meter or power usage meter) to transmit and receive data. For example, the antenna structure may be a component of a meter interface unit within the utility meter that enables wireless communication to/from the utility meter in multiple different bands (e.g., Long-Term Evolution (LTE) bands 4 and 13, 900 MHz Industrial, Scientific, and Medical (ISM) band, 2.4 GHz ISM (Bluetooth™)). The compact nature of the antenna structure, requiring the use of no external components (e.g., no components on an external PCB), enables the antenna to be fit within the physical constraints of existing meter interface units, or more easily fit within newly designed meter interface units that may be relatively small in size.

FIG. 1 depicts a three-dimensional view of a folded dipole antenna structure 100 according to an exemplary implementation. As shown, the folded dipole antenna structure 100 includes a planar dielectric 105 having a first side 110, and an opposite, second side 115. In the example shown, first side 110 may be a "top" side and the second side 115 may be a "bottom" side. Planar dielectric 105 may include one or more of various types of dielectric material, such as, for example, fiberglass, glass, plastic, mica, and metal oxide, and may have a thickness ($T_d$) ranging from approximately 0.008 inches to about 0.24 inches. In one exemplary implementation, planar dielectric 105 may have a thickness $T_d$ of 0.032 inches. The first side 110 of planar dielectric 105 has an antenna conductor layout 120 formed upon it. The antenna conductor layout 120 forms two parallel-connected folded dipoles, as described in further detail below.

The second side 115 of planar dielectric 105 includes a feed line conductor 125, and an impedance matching (IM) conductor 135 formed thereon. Feed line conductor 125 traces a pattern upon the second side 115 of planar dielectric 105 to connect a feed connector 150, through a via 1 145, to an antenna feed section 140 (described further below) of the antenna conductor layout 120 on the first side 110 of planar dielectric 105. In an example in which a transmitter (not shown) transmits signals via the antenna structure 100, the transmitter signals are received by the center conductor of feed connector 150, conveyed through via 1 145 to feed line conductor 125, conveyed along a length of the feed line conductor 125, and conveyed through a via 2 155 to the feed section 140 of the folded dipoles on the first side 110 of planar dielectric 105. In other implementations, signals may be conveyed from to feed section 140 via an open or shorted stub line. In an example in which a receiver (not shown) receives signals via the antenna structure 100, wireless signals received by antenna structure 100 are conveyed, via the feed section 140, through via 2 155, along a length of the feed line conductor 125, and conveyed through via 1 145 to the center conductor of feed connector 150.

IM conductor 135 includes a conductive trace that is formed at a position upon the second side 115 of planar dielectric 105 that is opposite of feed section 140 of conductor layout 120 on the first side 105 of planar dielectric 105 such that conductor 135 is capacitively coupled, across planar dielectric 105 to the feed section 140 of conductor 120 on the first side 110 of planar dielectric 105. The second side 115 of planar dielectric 105 may optionally have a secondary impedance matching conductor (not shown) formed at a location along the length of the feed line conductor 125.

Figure 2A:
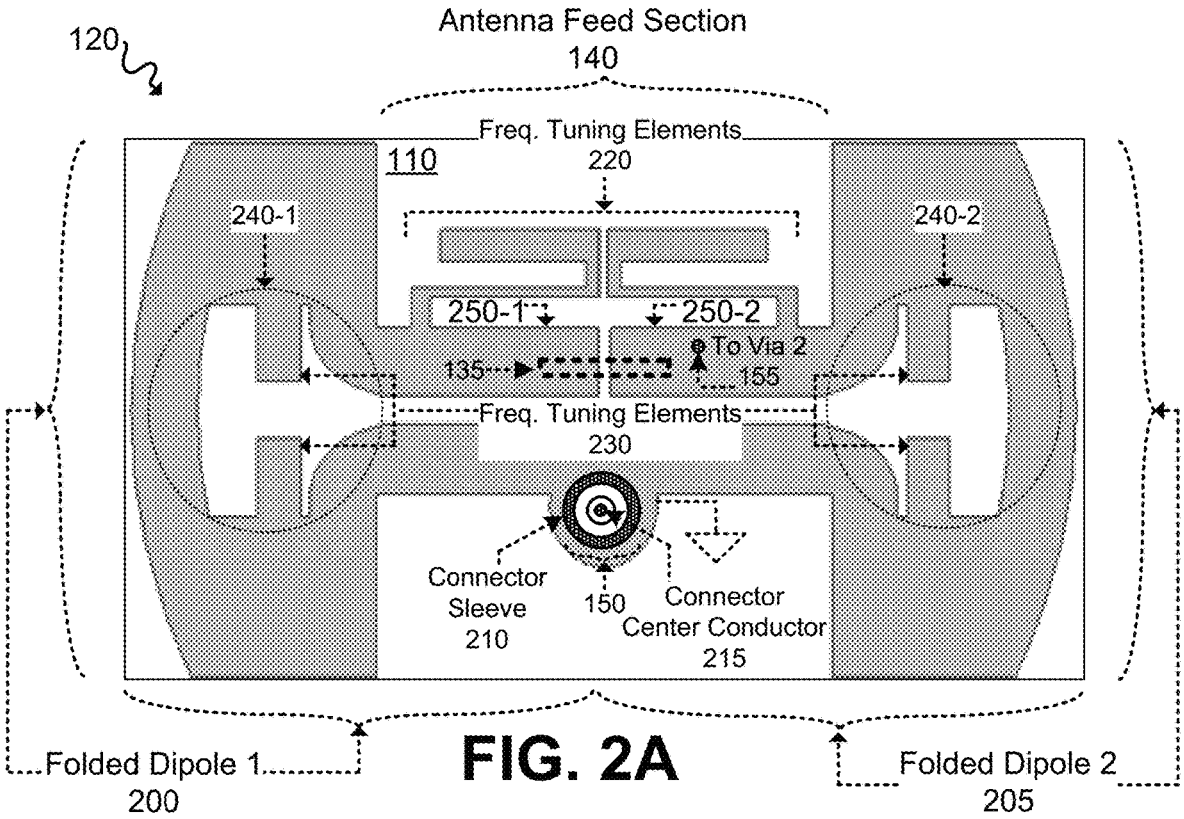
FIG. 2A depicts a two-dimensional top view of the first side of the antenna structure depicted in FIG. 1.
Figure 2B:
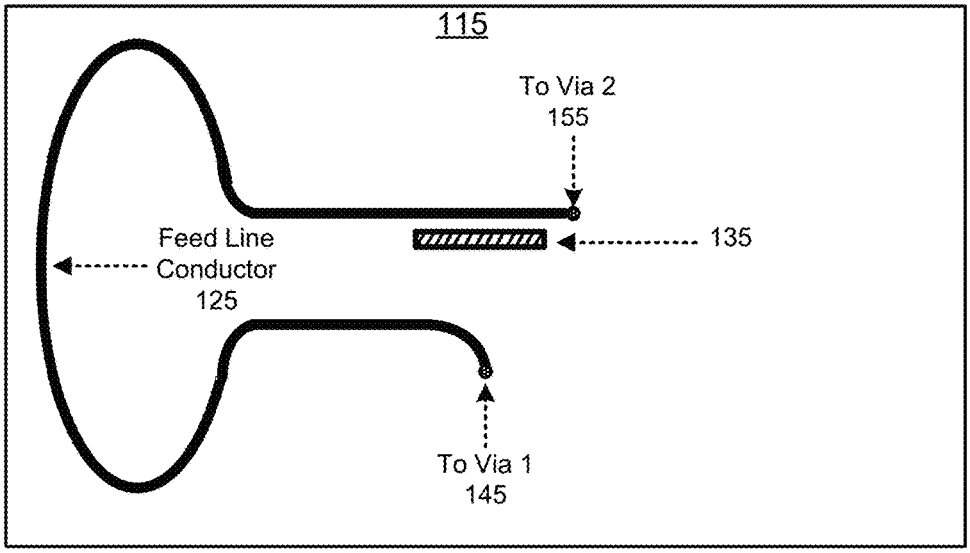
FIG. 2B depicts a two-dimensional "see-through" view of the second side of the antenna structure depicted in FIG. 1.

FIG. 2A depicts a two-dimensional "top" view of the first side 110 of antenna structure 100. FIG. 2B depicts a two-dimensional "see-through" view of the second side 115 of antenna structure 100. In the view of FIG. 2B, the material of planar dielectric 105 is depicted as transparent such that the underlying conductor layouts on the underside of planar dielectric 105 can be clearly seen. Returning to FIG. 2A, a left portion of the antenna conductor layout 120 includes a first folded dipole 200, and a right portion of the antenna conductor layout 120 includes a second folded dipole 205. As shown, feed connector 150 includes a common (e.g., ground) connection to the antenna conductor layout 120 via a connector sleeve 210 of connector 150. Both folded dipoles 200 and 205 are electrically connected to the common connection at feed connector 150. The center conductor 215 of connector 150 acts as the feed conductor and either supplies a transmitter signal (not shown) to feed line conductor 125 (FIG. 2B) through via 1 145 (not shown) or supplies a received signal from feed line conductor 125 and via 1 145 to a receiver (not shown) connected to connector 150. Feed line conductor 125 (FIG. 2B) supplies the transmitter signal through via 2 155 to feed section 140 of the antenna conductor layout 120. Therefore, folded dipole 200 and folded dipole 205 are connected in parallel with one another between the common connection at connector 150 and the feed connection from center conductor 215 of connector 150 (i.e., through via 2 155 to feed line conductor 125, through via 2 155, to feed section 140).

As shown in FIG. 2A, feed section 140 includes two frequency tuning elements 220, with the left-most tuning element being associated with folded dipole 1 200, and the right-most tuning element being associated with folded dipole 2 205. Each of the frequency tuning elements 220 may be modified to tune the lower resonance frequencies of antenna structure 100. A central region 240-1 of folded dipole 200 and a central region 240-2 of folded dipole 205 each includes additional pairs of frequency tuning elements 230. The left-most pair of tuning elements 230 are associated with folded dipole 1 200, and the right-most pair of tuning elements 230 are associated with folded dipole 2 205. Each of the pairs of frequency tuning elements 230 may be modified to tune the higher resonance frequencies of antenna structure 100.

As illustrated in FIGS. 2A and 2B, IM conductor 135 includes a conductive strip having, for example, a rectangular shape, that extends across a gap between the left side of feed section 140 to a right side of feed section 140 to electrically couple the two sides. In one implementation, IM conductor 135 may capacitively couple, across the dielectric material of planar dielectric 105, the left side of feed section 140 to the right side of feed section 140. In another implementation, two conductive vias (not shown) may extend through the planar dielectric 105 to connect a first end of IM conductor 135 to a left side of feed section 140, and a second end of IM conductor 135 to a right side of feed section 140. The registration or location of IM conductor 135, on second side 115, with the two sides of feed section 140 on the first side 110 is shown with dotted lines in the center of the conductor layout 120 in FIG. 2A. Additional details regarding dimensions of the components of an exemplary implementation of antenna conductor layout 120 are described below with respect to FIGS. 3, 4A, 4B, and 5.

As shown in FIG. 2B, via 1 145, which passes through the dielectric material of planar dielectric 105, electrically connects to a first end of feed line conductor 125. The feed line conductor 125 traces a circuitous pattern upon second side 115 of planar dielectric 105 that follows a portion of the pattern of antenna conductor layout 120 on the first side 110. A first end of feed line conductor 125 connects to center conductor 215 of connector 150 (FIG. 2A) through via 1 145, and a second end of feed line conductor 125 connects to feed section 140 of antenna conductor layout 120 through via 2 155. Additional details regarding dimensions of the various components formed on second side 115 of planar dielectric 105 of an exemplary implementation are described below with respect to FIG. 6.

Figure 3:
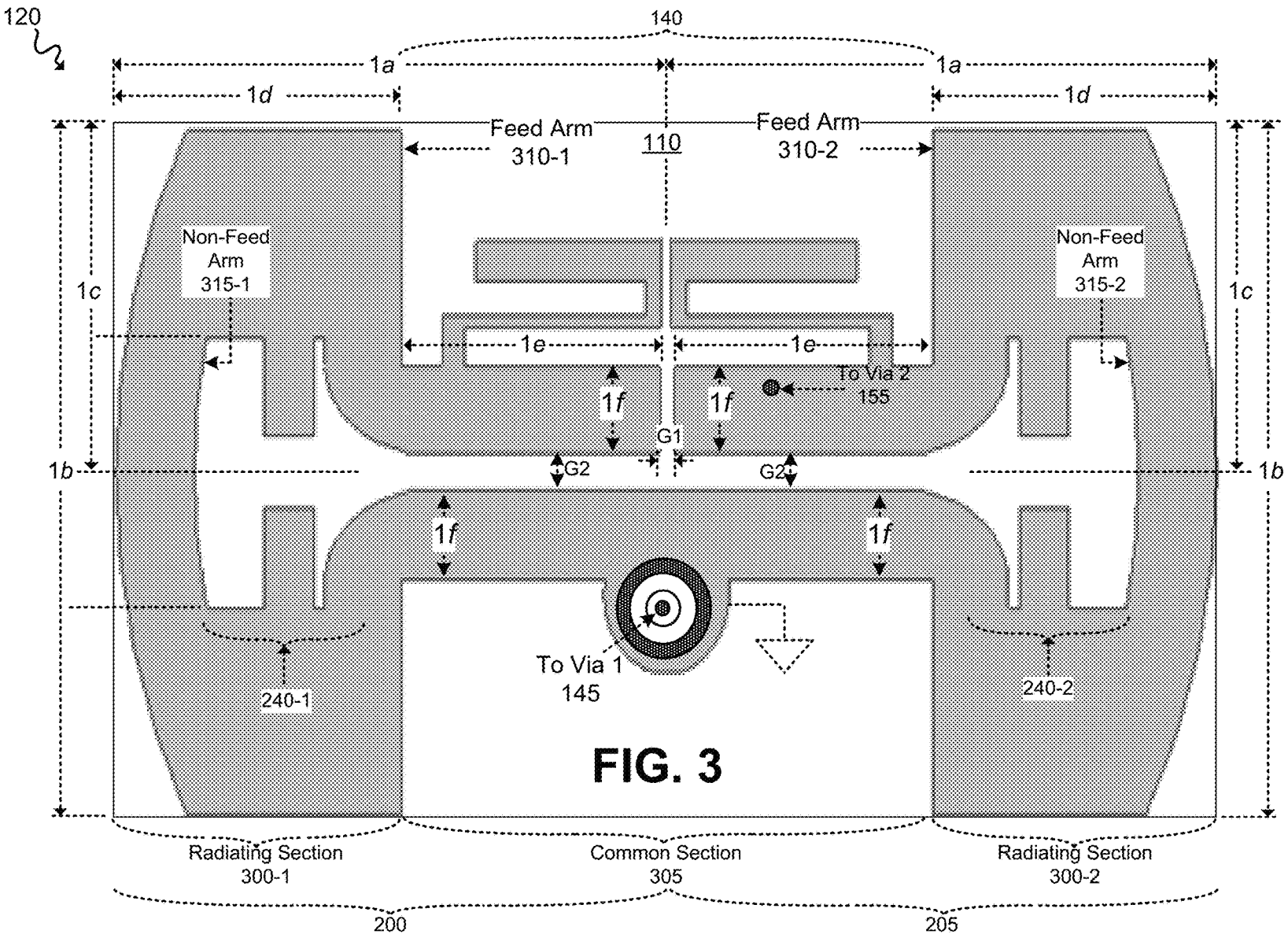
FIG. 3 depicts further details of the antenna conductor layout on the first side of the planar dielectric of FIG. 1 according to one exemplary implementation.

FIG. 3 depicts further details of antenna conductor layout 120 on first side 110 of the planar dielectric 105 according to one exemplary implementation. As shown, folded dipole 1 200 and folded dipole 2 205 of antenna conductor layout 120 may each have a length 1a and a width 1b. In one exemplary implementation, length 1a may be 2.450 inches and width 1b may be 2.400 inches. Further, each of folded dipoles 200 and 205 may be bisected with a center line that divides the width 1b to create a width 1c. In one implementation, 1c=½*1b.

As further depicted in FIG. 3, antenna conductor layout 120 includes feed section 140, a first radiating section 300-1 (corresponding to the folded portion of dipole 1 200, a second radiating section 300-2 (corresponding to the folded portion of dipole 2 205), and a common section 305. In one exemplary implementation, a length 1d of first radiating section 300-1 and second radiating section 300-2 may be 1.270 inches.

Feed section 140 may be divided into two sections, each having a length 1e and a width 1f, and each separated from one another by a gap G1 in the conductor material. In one exemplary implementation, the two sections of feed section 140 may have a length 1e of 1.170 inches, a width 1f of 0.315 inches, and a gap G1 of 0.020 inches. The two sections, each having a length 1e, of feed section 140 may be separated from common section 305 of antenna conductor layout 120 by a gap G2. In one exemplary implementation, the gap G2 may be 0.135 inches. Common section 305 may additionally have a width 1f, similar to width 1f of the two sections of feed section 140.

Folded dipole 200 300-1 includes a feed arm 310-1 that connects to a non-feed arm 315-1. Folded dipole 205 includes a feed arm 310-2 that connects to a non-feed arm 315-2. Feed arms 310-1 and 310-2 connect, respectively, to each of the two feed sections 140 having length 1e. Non-feed arm 315-1 and non-feed arm 315-2 both connect to common section 305. Radiating section 300-1 of folded dipole 200 includes a non-conductive central region 240-1 formed inside the conductive traces of the folded dipole 200 (e.g., inside feed arm 310-1 and non-feed arm 315-1). Radiating section 300-2 of folded dipole 205 also includes a non-conductive central region 240-2 formed inside the conductive traces of folded dipole 205 (e.g., inside feed arm 310-2 and non-feed arm 315-2). Central regions 240-1 and 240-2 may have similar configurations and dimensions, as described further below with respect to FIGS. 4A and 4B.

Figure 4A:
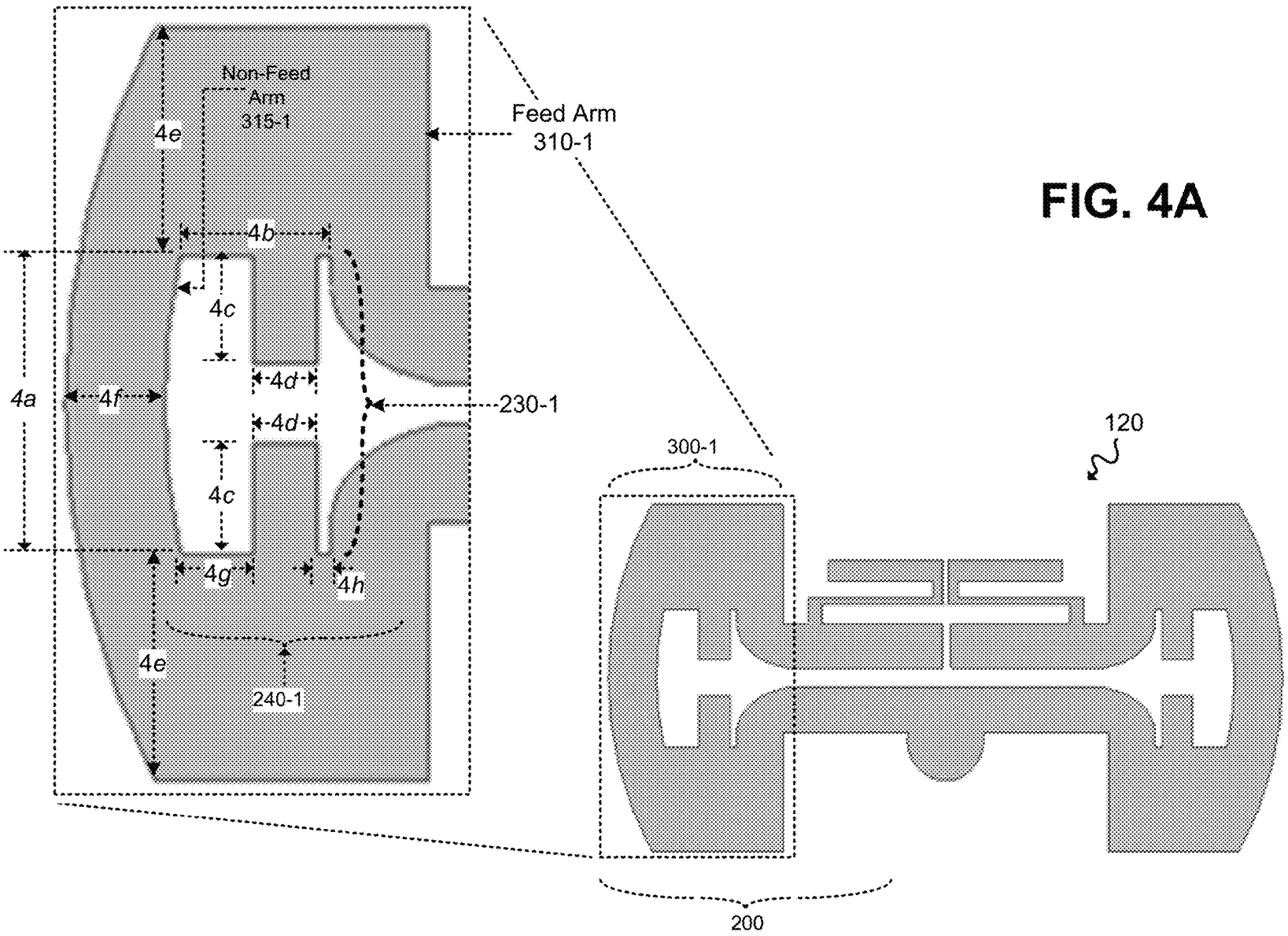
FIG. 4A illustrates an expanded view of a first radiating section of a first folded dipole of the conductor layout of FIG. 3.

FIG. 4A illustrates an expanded view of the radiating section 300-1 of folded dipole 200. As shown, the central region 240-1 of folded dipole 200 includes a pair of tuning stubs 230-1 formed as part of the conductive layout 120 on the upper and lower side of central region 240-1. Central region 240-1 has a length 4b and a width 4a. In one implementation, length 4b may be 0.525 inches and width 4a may be 0.950 inches. The upper tuning stub of stubs 230-1 may have a length 4d and a width 4c. Similarly, the lower tuning stub of stubs 230-1 may have a length 4d and a width 4c. In one implementation, length 4d may be 0.223 inches and width 4c may be 0.350 inches. As shown, the portion of the conductive layout 120 on the upper side of central region 240-1 may have a width of 4e, and the portion of the conductive layout on the lower side of central region 240-1 may also have a width of 4e. In one implementation, 4e may be 0.725 inches. The portion of the conductive layout 120 on the left side of central region 240-1 may have a length of 4f. In one implementation, 4f may be 0.350 inches. Each of tuning stubs 230-1 may be located a distance 4g from the left-most edge of central region 240-1, and a distance 4h from the right-most edge of central region 240-1 of folded dipole 200. In one implementation, 4g may be 0.252 inches and 4h may be 0.050 inches.

Figure 4B:
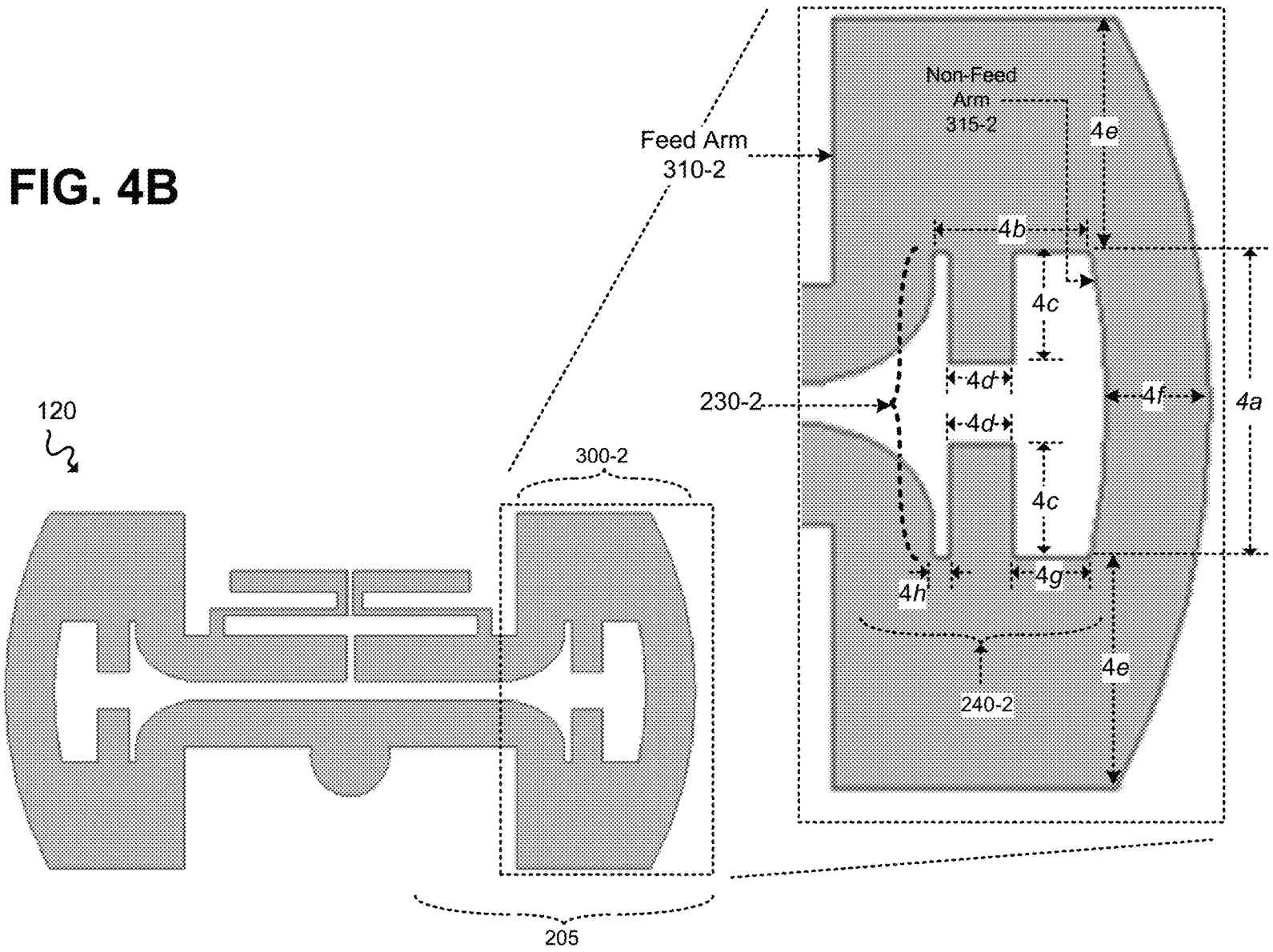
FIG. 4B illustrates an expanded view of a second radiating section of a second folded dipole of the conductor layout of FIG. 3.

FIG. 4B depicts an expanded view of the radiating section 300-2 of folded dipole 205. As shown, the central region 240-2 of folded dipole 205 includes a pair of tuning stubs 230-2 formed as part of the conductive layout 120 on the upper and lower side of central region 240-2. Central region 240-2 has a length 4b and a width 4a. In one implementation, length 4b may be 0.525 inches and width 4a may be 0.950 inches. The upper tuning stub of stubs 230-2 may have a length 4d and a width 4c. Similarly, the lower tuning stub of stubs 230-2 may have a length 4d and a width 4c. In one implementation, length 4d may be 0.223 inches and width 4c may be 0.350 inches. As shown, the portion of the conductive layout 120 on the upper side of central region 240-2 may have a width of 4e, and the portion of the conductive layout on the lower side of central region 240-2 may also have a width of 4e. In one implementation, 4e may be 0.725 inches. The portion of the conductive layout 120 on the right side of central region 240-2 may have a length of 4f. In one implementation, 4f may be 0.350 inches. Each of tuning stubs 230-2 may be located a distance 4g from the right-most edge of central region 240-2, and a distance 4h from the left-most edge of central region 240-2 of folded dipole 205. In one implementation, 4g may be 0.252 inches and 4h may be 0.050 inches. The various dimensions of tuning stubs 230-1 and 230-2 (e.g., 4c, 4d, 4h, 4g), and radiating sections 300-1 and 300-2 (e.g., 4a, 4f 4b, 4e) may be modified to tune the higher resonance frequencies of antenna structure 100.

Figure 5:
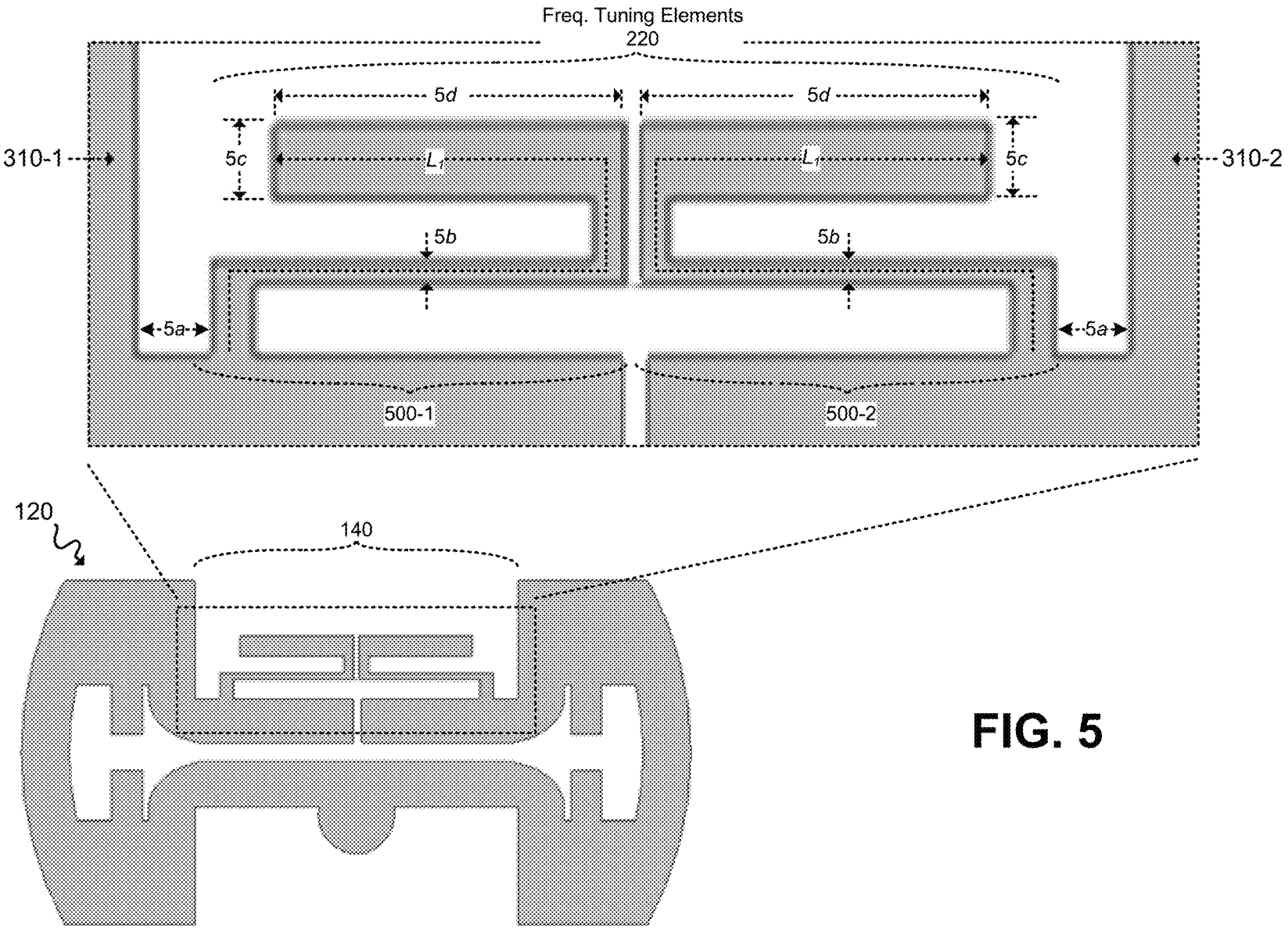
FIG. 5 illustrates an expanded view of the feed section of the conductor layout of FIG. 3.

FIG. 5 illustrates an expanded view of feed section 140 of conductor layout 120. The frequency tuning elements 220 of feed section 140 include a first frequency tuning element 500-1 and a second frequency tuning element 500-2. Frequency tuning element 500-1 connects to the left-most portion of feed section 140 at a distance 5a from feed arm 310-1 of radiating section 300-1. A conductive trace of frequency tuning element 500-1 has a length $L_1$ and has a width of 5b extending most of the length $L_1$. Another portion of frequency tuning element 500-1 has a length 5d length and a width of 5c. Frequency tuning element 500-2 connects to the right-most portion of feed section 140 at a distance 5a from feed arm 310-2 of radiating section 300-2. A conductive trace of frequency tuning element 500-2 has the length $L_1$ and has a width of 5b extending most of the length $L_1$. Another portion of frequency tuning element 500-2 has a length 5d and a width of 5c. In one exemplary implementation, 5a may be 0.180 inches, 5b may be 0.044 inches, 5c may be 0.145 inches, and 5d may be 0.840 inches. As shown in FIG. 5, the conductive traces of frequency tuning elements 500-1 and 500-2 may be formed in a winding or circuitous shape that enables the lengths $L_1$ to fit within a limited space upon first side 110 of planar dielectric 105 within antenna feed section 140, thereby minimizing the use of an area upon or within planar dielectric 105. The various dimensions of frequency tuning elements 500-1 and 500-2 may be modified to tune the lower resonance frequencies of antenna structure 100.

Figure 6:
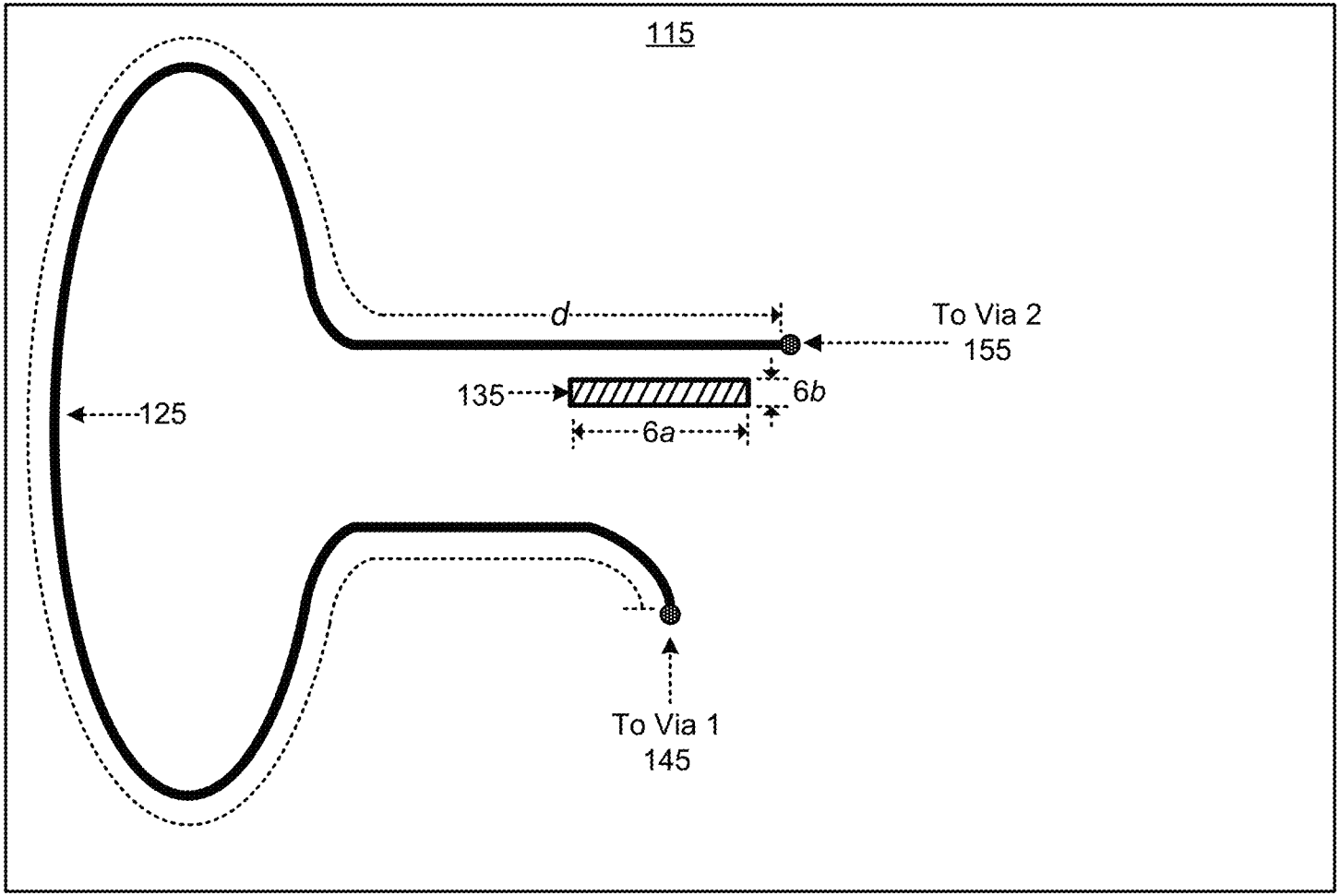
FIG. 6 depicts further details of the conductor layout on the second side of the planar dielectric of FIG. 1 according to an exemplary implementation.

FIG. 6 depicts further details of the second side 115 of the planar dielectric 105 according to one exemplary implementation. As shown, feed line conductor 125 may include a conductive microstrip line that traces a path, that roughly corresponds to a shape of a portion of antenna conductor layout 120 on the first side 110, from a connection with via 1 145 to a connection with via 2 155. An optional impedance matching element (not shown), including a conductive element having a length and a width, may be formed at a distance from the connection to via 1 145 along the conductive strip-line of feed line conductor 125 upon second side 115. The length, width, and distance of the optional impedance matching element along the conductive strip-line of feed line conductor 125 may each be selected to adjust the impedance of folded dipole antenna structure 100 for impedance matching.

As further shown in FIG. 6, IM conductor 135 may include a conductive element having a length 6a and a width 6b, formed upon second side 115 such that a first end (the left side of element 135) is disposed opposite the left portion of feed section 140 of antenna conductor layout 120 to enable the first end to capacitively couple to the left end of feed section 140 through the dielectric material of planar dielectric 105. Additionally, IM conductor 135 may be formed upon second side 115 such that a second end (the right side of IM conductor 135) is disposed opposite the right portion of feed section 140 of antenna conductor layout 120 to enable the second end to capacitively couple to the right end of feed section 140 through the dielectric material of planar dielectric 105. IM conductor 135, therefore, electrically couples across gap G1 (FIG. 3) between the two separate sections of feed section 140 of antenna conductor layout 120. In one exemplary implementation, length 6a may be 0.400 inches and width 6b may be 0.040 inches. The length 6a of IM conductor 135 may be selected so as to tune the impedance of antenna structure 100.

Figure 7:
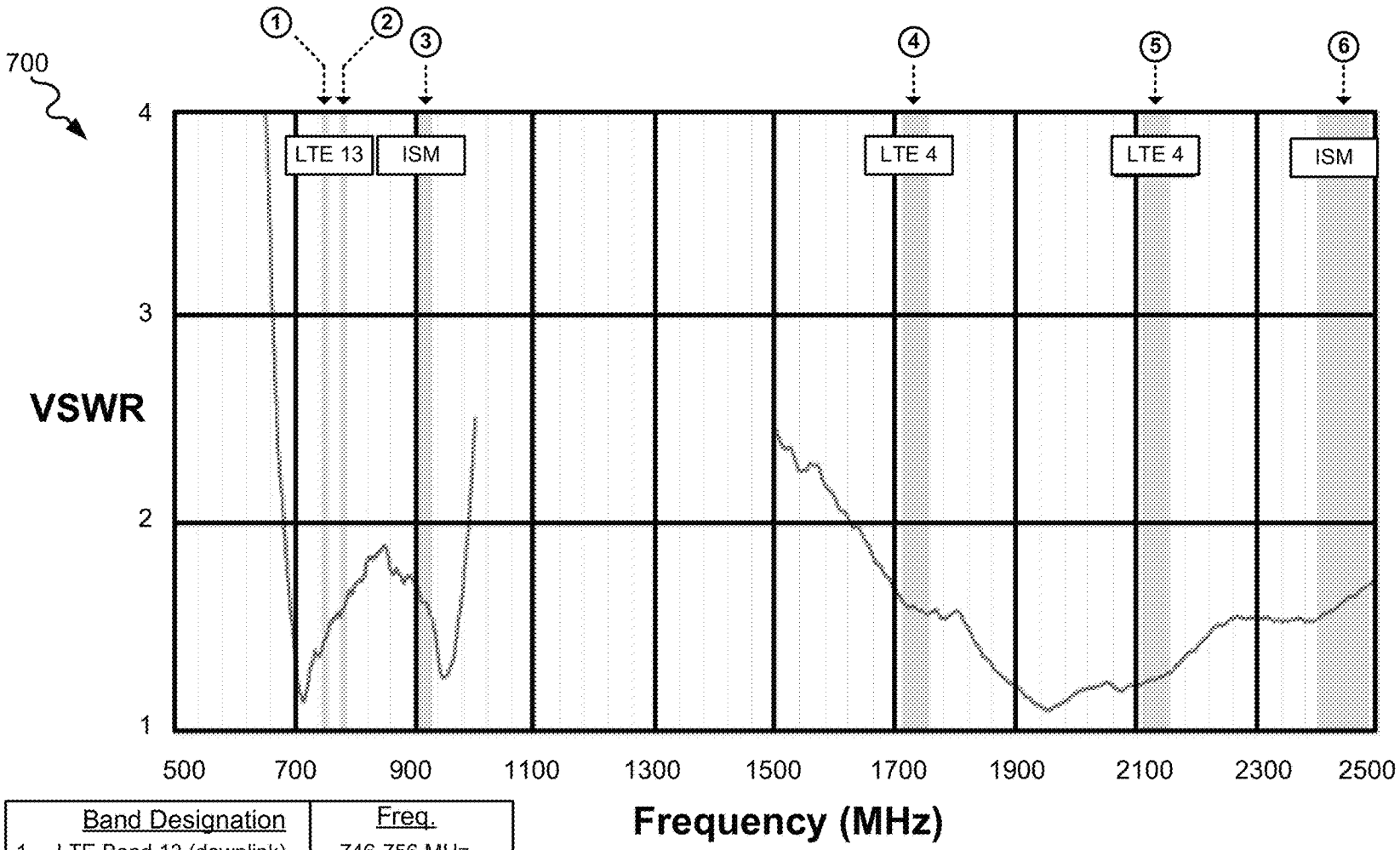
FIG. 7 depicts a plot of Voltage Standing Wave Ratio versus frequency for an exemplary folded dipole antenna structure corresponding to FIG. 1.

FIG. 7 depicts a plot 700 of Voltage Standing Wave Ratio (VSWR) versus frequency for an exemplary implementation of the folded dipole antenna structure 100 described herein. The x-axis of the plot 700 includes frequency, ranging from 500 MegaHertz (MHz) to 2.5 GigaHertz (GHz). The y-axis of the plot 700 includes VSWR, ranging from 1.00 to 4.00. As is understood in the art, for a transmitter to deliver power to an antenna, or receive power from the antenna, the impedance of the transmitter/receiver and the transmission line must be well matched to the antenna's impedance. The VSWR parameter of an antenna numerically measures how well the antenna is impedance matched to the transmitter/receiver. The smaller an antenna's VSWR is, the better the antenna is matched to the transmitter/receiver and the transmission line, and the more power is delivered to/from the antenna. The minimum VSWR of an antenna is 1.0, at which no power is reflected from the antenna. Bandwidth requirements of antennas are typically expressed in terms of VSWR. For example, an antenna for a particular application may need to operate from 1.0 GHz to 1.3 GHz with a VSWR less than 3.0.

In the plot 700 of FIG. 7, the plotted VSWR indicates that the exemplary implementation of the folded dipole antenna structure 100 described herein has at least six separate frequency bands (each shown as a different shaded band in FIG. 7) at which the VSWR is 2.0 or lower. The first frequency band (frequency band 1) encompasses the Long-Term Evolution (LTE) Band 13 (downlink) which spans from the lower frequency of about 746 MHz to the higher frequency of about 756 MHz. The second frequency band (frequency band 2) encompasses the LTE Band 13 (uplink) which spans from the lower frequency of about 777 MHz to the higher frequency of about 787 MHz. The third frequency band (frequency band 3) encompasses the 900 MHz ISM band which spans from the lower frequency of about 902 MHz to the higher frequency of about 928 MHz. The fourth frequency band (frequency band 4) encompasses the LTE band 4 (uplink) which spans from the lower frequency of about 1710 MHz to the higher frequency of about 1755 MHz. The fifth frequency band (frequency band 5) encompasses the LTE band 4 (downlink) which spans from the lower frequency of about 2110 MHz to the higher frequency of about 2155 MHz. The sixth frequency band (frequency band 6) encompasses the 2.4 GHz ISM band (Bluetooth™) which spans from the lower frequency of about 2400 MHz to the higher frequency of about 2483.5 MHz. The antenna's impedance is, therefore, well matched to the transmitter/receiver and the transmission line within the six frequency bands shown in FIG. 7. One skilled in the art will recognize, however, that the frequency bands depicted in FIG. 7 may be changed based on changing the dimensions of the antenna structure 100, such as, for example, changing the lengths and/or widths 1a, 1b, 1d, 4a, 4b, 4c, 4d, 4e, 4f 4g, and/or 4h of the antenna conductor layout 120 and/or dimensions of feed line conductor 125 and IM conductor 135.

Figure 8B:
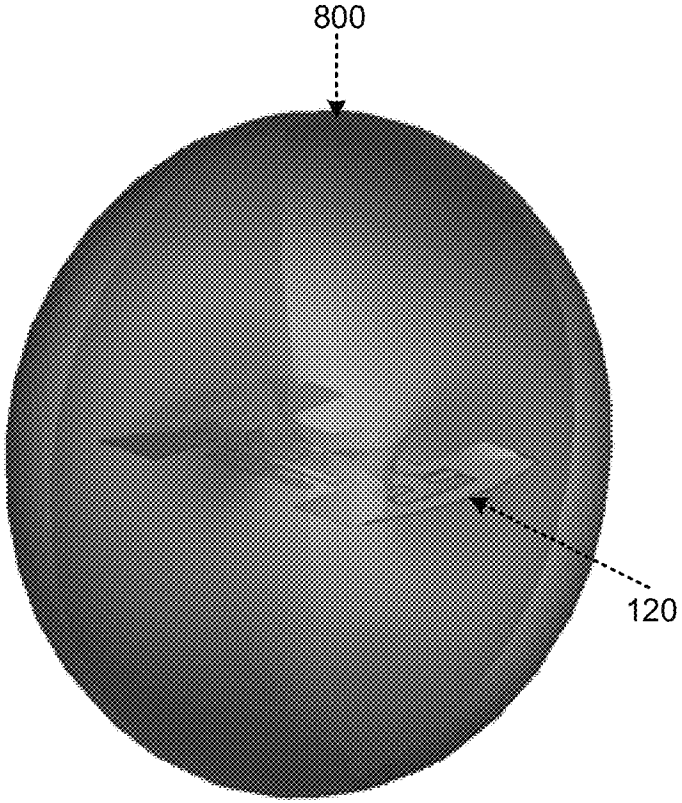
FIGS. 8A and 8B illustrate three-dimensional radiation patterns associated with the folded dipole antenna structure of FIG. 1 at a frequency of 750 Megahertz.
Figure 8A:
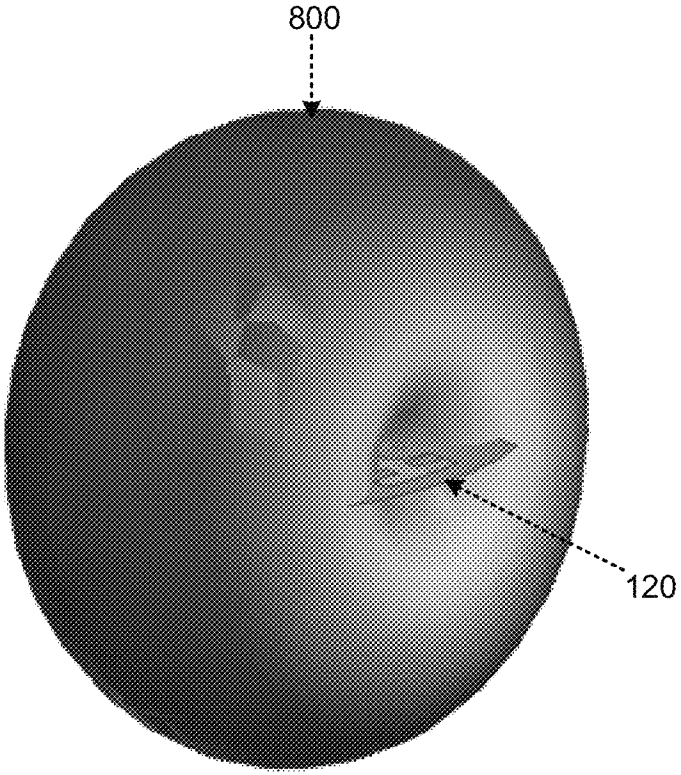

FIGS. 8A and 8B illustrate a three-dimensional (3D) radiation pattern 800 associated with folded dipole antenna structure 100 at a frequency of 750 MHz. FIG. 8A depicts an external view of radiation pattern 800, and FIG. 8B depicts a transparent view of radiation pattern 800 such that antenna conductor layout 120 can be seen within the radiation pattern 800. As shown in FIGS. 8A and 8B, radiation pattern 800 has a horn torus-like shape.

Figure 9B:
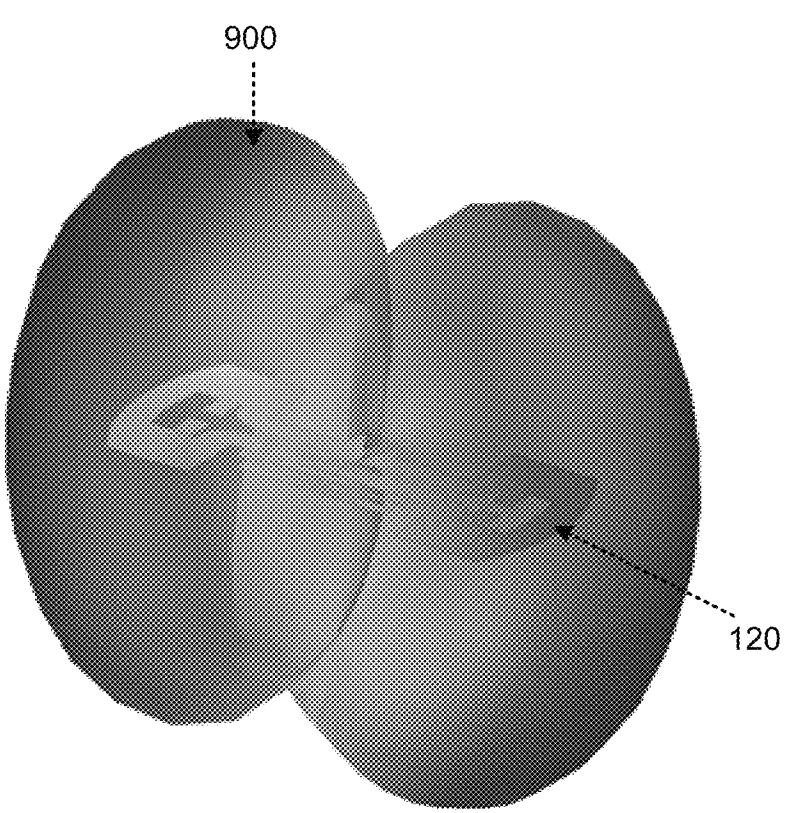
FIGS. 9A and 9B illustrate three-dimensional radiation patterns associated with the folded dipole antenna structure of FIG. 1 at a frequency of 1800 Megahertz.
Figure 9A:
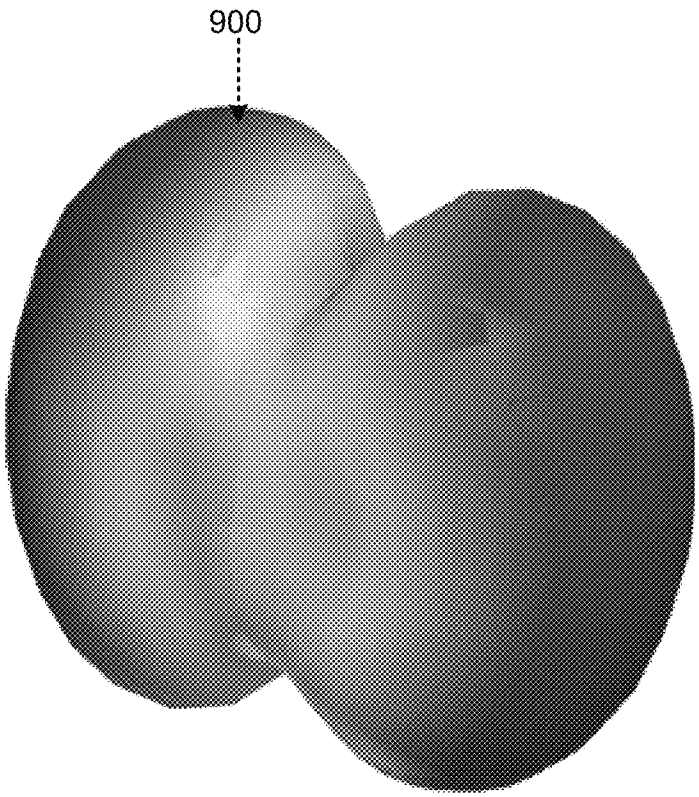

FIGS. 9A and 9B illustrate a 3D radiation pattern 900 associated with folded dipole antenna structure 100 at a frequency of 1800 MHz. FIG. 9A depicts an external view of radiation pattern 900, and FIG. 9B depicts a transparent view of radiation pattern 900 such that antenna conductor layout 120 can be seen within radiation pattern 900. As shown in FIGS. 9A and 9B, radiation pattern 900 has a two-lobed dumbbell-like shape.

Figure 10B:
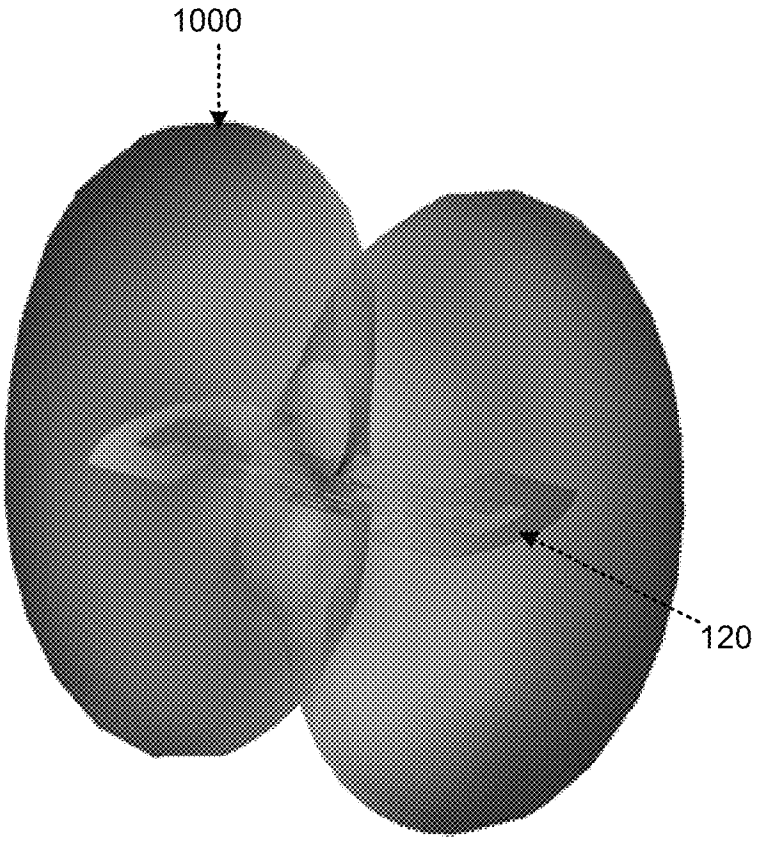
FIGS. 10A and 10B illustrate three-dimensional radiation patterns associated with the folded dipole antenna structure of FIG. 1 at a frequency of 2150 Megahertz.
Figure 10A:
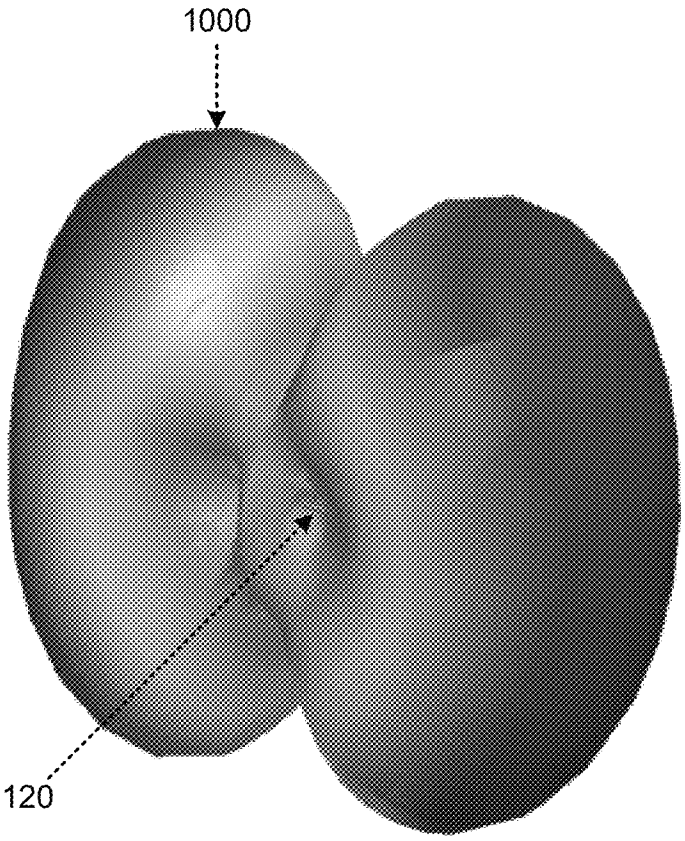

FIGS. 10A and 10B illustrate a 3D radiation pattern 1000 associated with folded dipole antenna structure 100 at a frequency of 2150 MHz. FIG. 10A depicts an external view of radiation pattern 1000, and FIG. 10B depicts a transparent view of radiation pattern 1000 such that antenna conductor layout 120 can be seen within radiation pattern 1000. As shown in FIGS. 10A and 10B, radiation pattern 1000 has a two-lobed pinched dumbbell-like shape.

The foregoing description of implementations provides illustration and description, but is not intended to be exhaustive or to limit the invention to the precise form disclosed. Modifications and variations are possible in light of the above teachings or may be acquired from practice of the invention. For example, various antenna patterns have been shown and various exemplary dimensions have been provided. It should be understood that different patterns and/or dimensions may be used than those described herein. Various dimensions associated with, for example, antenna conductor layout 120, planar dielectric 105, feed line conductor 125, and impedance matching element 135 have been provided herein. It should be understood that different dimensions of the conductor elements and the dielectric, such as different lengths, widths, thicknesses, etc., may be used than those described herein. The resonant frequencies, and antenna impedance, of antenna structure 100 may be adjusted based on varying the relative lengths, widths, and/or thickness of the antenna components described herein.

Certain features described above may be implemented as "logic" or a "unit" that performs one or more functions. This logic or unit may include hardware, such as one or more processors, microprocessors, application specific integrated circuits, or field programmable gate arrays, software, or a combination of hardware and software.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

What is claimed is:

1. An antenna, comprising:
a first folded dipole having a first central region;
a second folded dipole having a second central region and connected in parallel to the first folded dipole;
a first pair of tuning stubs extending into the first central region of the first folded dipole; and
a second pair of tuning stubs extending into the second central region of the second folded dipole.

2. The antenna of claim 1, further comprising:
a planar dielectric, wherein the first folded dipole and the second folded dipole are formed on a first side of the planar dielectric.

3. The antenna of claim 2, further comprising:
a feed line conductor, formed on a second side of the planar dielectric, that couples to a feed section of the first and second folded dipoles.

4. The antenna of claim 3, further comprising:
an impedance matching conductor formed on the second side of the planar dielectric and electrically coupled to the feed section of the first and second folded dipoles.

5. The antenna of claim 1, wherein the first and second pair of tuning stubs control higher resonant frequencies of the antenna.

6. The antenna of claim 1, further comprising:
a first tuning element connected to a first portion of an antenna feed section; and
a second tuning element connected to a second portion of the antenna feed section.

7. The antenna of claim 6, further comprising:
a planar dielectric, wherein the first folded dipole, the second folded dipole, the antenna feed section, the first tuning element, and the second tuning element are formed on a first side of the planar dielectric.

8. The antenna of claim 6, wherein the first and second tuning elements control lower resonant frequencies of the antenna.

9. An antenna structure, comprising:
a dielectric;
a conductor layout formed on the dielectric, wherein the conductor layout comprises:
a first folded dipole having a first central non-conductive region,
a second folded dipole having a second central non-conductive region and coupled in parallel to the first folded dipole,
a first pair of tuning stubs extending into the first central non-conductive region of the first folded dipole, and
a second pair of tuning stubs extending into the second central non-conductive region of the second folded dipole; and
a feed line conductor formed on the dielectric and coupled to a feed section of the first and second folded dipoles.

10. The antenna structure of claim 9, wherein the dielectric comprises a planar dielectric, wherein the conductor layout is formed on a first side of the planar dielectric, and wherein the feedline conductor is formed on a second side of the planar dielectric that is opposite to the first side.

11. The antenna structure of claim 10, wherein the conductor layout further comprises:
an impedance matching conductor formed on the second side of the planar dielectric and electrically coupled to the feed section of the first and second folded dipoles.

12. The antenna structure of claim 9, wherein the first and second pair of tuning stubs control higher resonant frequencies of the antenna.

13. The antenna structure of claim 9, wherein the conductor layout further comprises:
a first tuning element connected to a first portion of the feed section; and
a second tuning element connected to a second portion of the feed section.

14. The antenna structure of claim 13, wherein the dielectric comprises a planar dielectric, and wherein the conductor layout, the feed section, the first tuning element, and the second tuning element are formed on the first side of the planar dielectric.

15. The antenna structure of claim 13, wherein the first and second tuning elements control lower resonant frequencies of the antenna.

16. An antenna structure included in a utility meter, comprising:
a planar dielectric;
a conductor layout formed on a first side of the planar dielectric, wherein the conductor layout forms a first folded dipole connected in parallel to a second folded dipole, and wherein the first folded dipole has a first central region and the second folded dipole has a second central region, the conductor layout further comprising:
a first pair of tuning stubs extending into the first central region of the first folded dipole, and
a second pair of tuning stubs extending into the second central region of the second folded dipole;
a feed line conductor formed on a second side of the planar dielectric, opposite to the first side; and
an impedance matching conductor formed on the second side of the planar dielectric.

17. The antenna structure of claim 16, wherein the feed line conductor electrically couples to a feed section of the first and second folded dipoles, and wherein the impedance matching conductor capacitively couples to the feed section of the first and second folded dipoles through the planar dielectric.

18. The antenna structure of claim 16, wherein the first and second pair of tuning stubs control higher resonant frequencies of the antenna.

19. The antenna structure of claim 16, wherein the conductor layout further comprises:
a first tuning element connected to a first portion of an antenna feed section of the conductor layout; and
a second tuning element connected to a second portion of the antenna feed section of the conductor layout,
wherein the first and second tuning elements are formed on the first side of the planar dielectric.

20. The antenna structure of claim 19, wherein the first and second tuning elements control lower resonant frequencies of the antenna.

* * * * *